US005929879A

United States Patent [19]

Karita et al.

[11] Patent Number: 5,929,879

[45] Date of Patent: Jul. 27, 1999

[54] INK JET HEAD HAVING EJECTION OUTLET WITH DIFFERENT OPENINGS ANGLES AND WHICH DRIVES EJECTION ENERGY GENERATING ELEMENTS IN BLOCKS

[75] Inventors: Seiichiro Karita, Yokohama; Hiroshi Sugitani, Machida; Yasuroh Kashima, Fukushima, all of Japan

[73] Assignee: Canon Kabushiki Kaisha, Tokyo, Japan

[21] Appl. No.: 08/511,620

[22] Filed: Aug. 7, 1995

[30] Foreign Application Priority Data

Aug. 5, 1994 [JP] Japan ..... 6-184476

[51] Int. Cl.[6] ..... B41J 2/145; B41J 29/38; B41J 2/14

[52] U.S. Cl. ..... 347/40; 347/47; 347/13

[58] Field of Search ..... 342/40, 42, 47, 342/37, 39; 347/13, 40, 47

[56] References Cited

U.S. PATENT DOCUMENTS

| | | | |
|---|---|---|---|
| 4,412,224 | 10/1983 | Sugitani | 347/65 |
| 4,417,251 | 11/1983 | Sugitani | 347/65 |
| 4,437,100 | 3/1984 | Sugitani et al. | 347/65 |
| 4,450,455 | 5/1984 | Sugitani et al. | 347/45 |
| 4,509,063 | 4/1985 | Sugitani et al. | 347/65 |
| 4,521,787 | 6/1985 | Yokota et al. | 347/65 |
| 4,558,333 | 12/1985 | Sugitani et al. | 347/65 |
| 4,611,219 | 9/1986 | Sugitani et al. | 347/40 |
| 4,666,823 | 5/1987 | Yokota et al. | 430/320 |
| 5,357,268 | 10/1994 | Kishida et al. | 347/13 |
| 5,389,957 | 2/1995 | Kimura et al. | 347/20 |

FOREIGN PATENT DOCUMENTS

| | | | |
|---|---|---|---|
| WO 091017051 | 11/1991 | WIPO | 347/40 |

*Primary Examiner*—N. Le
*Assistant Examiner*—Thien Tran
*Attorney, Agent, or Firm*—Fitzpatrick, Cella, Harper & Scinto

[57] ABSTRACT

An ink jet head for effecting recording by selectively ejecting ink onto a recording material, includes an array of ejection outlets; a plurality of ink flow paths each having an ejection energy generating element for ejecting the ink, the ink flow paths being in fluid communication with ejection outlets; a common liquid chamber for supplying the ink to the a plurality of ink flow paths; wherein the plurality of the ejection energy generating elements are grouped into blocks of a predetermined number of ejection energy generating elements, and actuation timing for the ejection energy generating elements is deviated for each blocks; wherein the ejection outlets have different opening angles for respective blocks in a direction of reducing deviation of recording positions between respective blocks.

11 Claims, 8 Drawing Sheets

INK JET HEAD HAVING EJECTION OUTLET WITH DIFFERENT OPENINGS ANGLES AND WHICH DRIVES EJECTION ENERGY GENERATING ELEMENTS IN BLOCKS

FIELD OF THE INVENTION AND RELATED ART

The present invention relates to an ink jet head, more particularly to the ink jet head usable with a recording device such as a copying machine or printer, wherein ink is ejected through a plurality of ink ejection outlets formed in an ink ejection surface.

With the structure of conventional ink jet head, a plurality of ejection outlets are arranged in a line on the surface of the ejection outlet. And, there are provided a plurality of ink passages having ejection energy generating elements for respective ejection outlets, and a common liquid chamber for supplying the ink to the ink flow paths.

When the ink is supplied by driving the ejection energy generating elements of the ink jet head having such a structure, the ejection of the ink through the ejection outlet may be rendered non-stable by propagation of the pressure wave produced in the previous actuation of the ejection energy generating element to the common liquid chamber side.

In order to prevent such an influence, thee ink ejection outlet array is divided in terms of the ejection timing into several blocks, and the actuations are carried out for the blocks (time sharing drive).

When recording using normal ink jet head, the recording is carried out while relative movement is imparted between the ejection outlet surface and the recording material. So, with the time sharing driving, when a longitudinal line portion perpendicular to the relative movement therebetween is recorded, the time deviation resulting from the time sharing driving, may be recorded with steps (offset) or saw tooth deviation, thus deteriorating the recording quality.

SUMMARY OF THE INVENTION

Accordingly, it is a principal object of the present invention to provide an ink jet recording head and a method of a type wherein the energy generating means are subjected to divided driving, and wherein the positional deviation of the ink droplets on the recording material is corrected to enable high quality recording.

According to an aspect of the present invention, there is provided an ink jet head for effecting recording by selectively ejecting ink onto a recording material, comprising an array of ejection outlets; a plurality of ink flow paths each having an ejection energy generating element for ejecting the ink, the ink flow paths being in fluid communication with ejection outlets; a common liquid chamber for supplying the ink to the a plurality of ink flow paths; wherein the plurality of the ejection energy generating elements are grouped into blocks of a predetermined number of ejection energy generating elements, and actuation timing for the ejection energy generating elements is deviated for each block; wherein the ejection outlets have different opening angles for respective blocks in a direction of reducing deviation of recording positions between respective blocks.

According to another aspect of the present invention, there is provided an apparatus having the above described ink jet head and a driving signal supply means for driving the ink jet head.

According to the present invention, when recording a longitudinal line extending in a direction of a line of an ink ejection outlet array's direction, for example, the conventional drawback resulting from the difference in the shot position, can be prevented. These and other objects, features and advantages of the present invention will become more apparent upon consideration of the following invention taken in conjunction with the accompanying drawings.

DESCRIPTION OF THE PREFERRED EMBODIMENT

Referring to the accompanying drawings, the embodiments of the present invention will be described.

Figure 1:
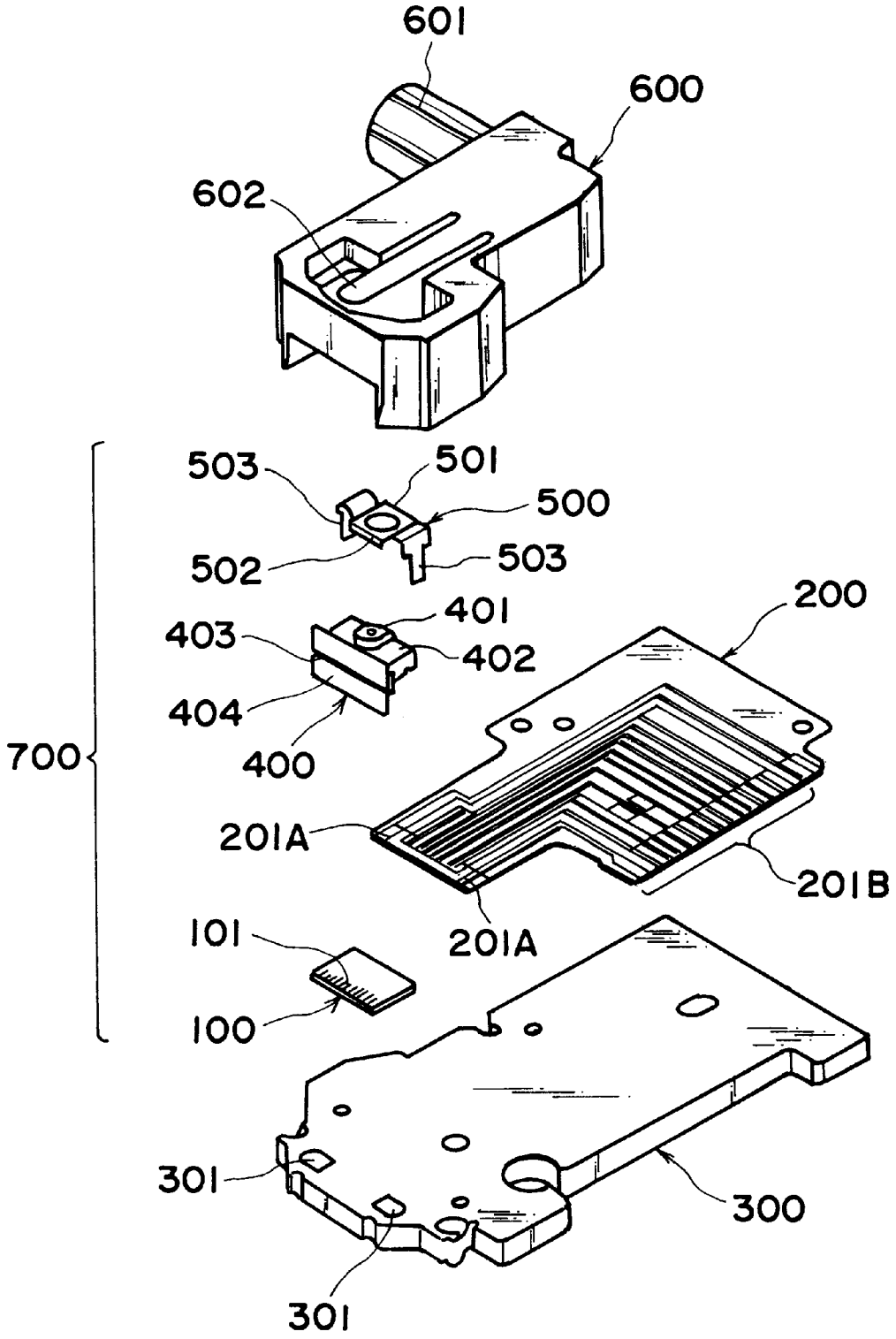
FIG. 1 is an exploded perspective view showing a structure of an ink jet head unit to which the present invention is applicable.
Figure 2:
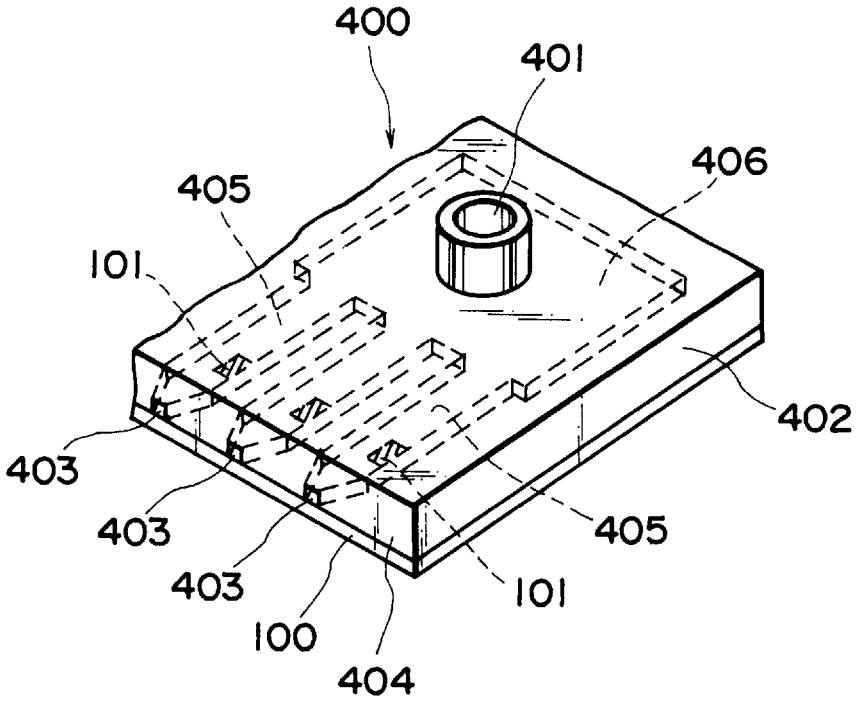
FIG. 2 is a perspective view showing an example of a head portion to which the present invention is applicable.
Figure 3:
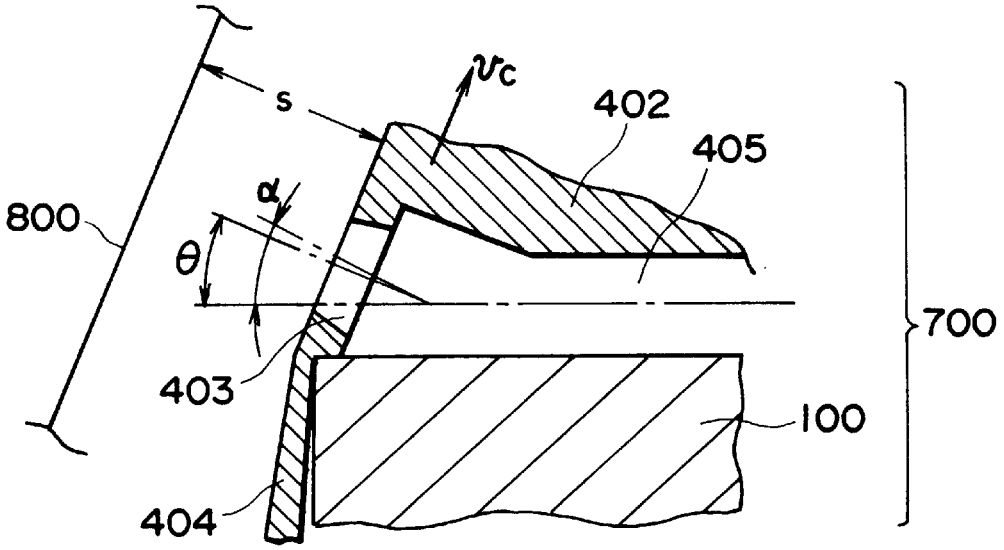
FIG. 3 is a sectional view showing a structure around ink ejection outlets of an ink jet head according to the present invention.
Figure 4:
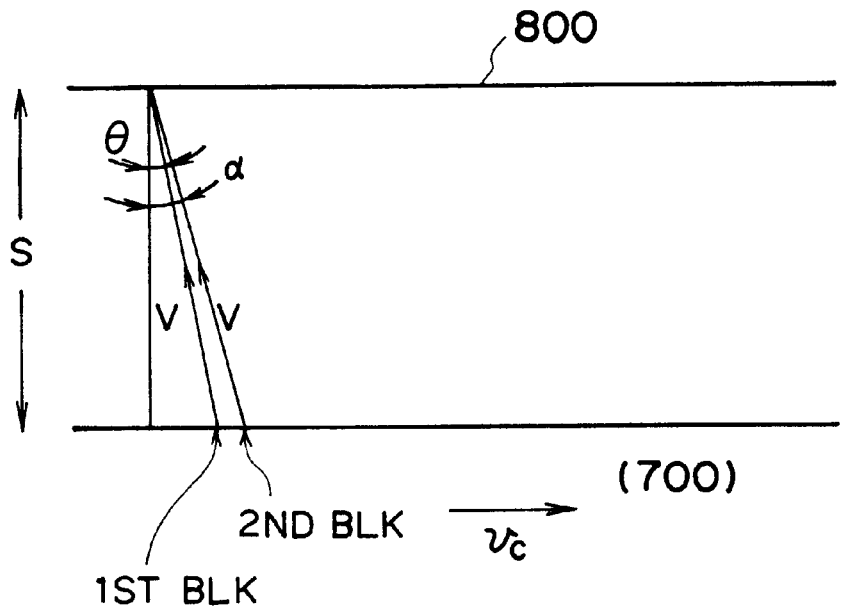
FIG. 4 illustrates a relationship between the ink ejection angle and the ink droplet shot position in an ink jet head according to the present invention.

Referring to FIGS. 1–3, the description will be made as to an ink jet head unit having a recording head portion and an ink accommodation portion as an unit.

FIG. 1 shows an example of an unit IJU except for the ink accommodation portion. Designated by 100 is a heater board. 200 is a wiring substrate having wiring for supplying an electrical signal for recording to electrical heat conversion member 101 (ejection energy generating element) on the heater board 100 and pads 201A, 201B for electric connections. 300 is a support having a top surface on which the wiring substrate 200 is mounted by adhesive material or the like, and 400 is an ink ejection portion formation member. 500 is a confining spring for pressing and fixing the ink ejection portion formation member 400 and a heater board 100 with correct alignment therebetween.

Ink ejection portion formation member 400 integrally has a top plate portion 402 having a receptor opening 401 and a portion 404 having a line of ink ejection outlets 403. A lower surface, in this Figure, of the top plate portion 402 is provided with a common liquid chamber 406 and liquid passages 405 at positions corresponding to the electrical heat conversion elements 101 on the heater board 100 as shown in FIGS. 2 and 3. One, confining spring 500 is M-shaped, and lightly presses the central portion of the top plate portion 402 by the central portion 501 thereof, and the bend portion 502 presses the liquid passages 405, preferably adjacent to the ink ejection outlet 403, along the line extending in an arrangement direction. Designated by 503 are mounting legs at both sides of the spring 500. They fix the ink ejection portion formation member 400 and heater board 100 on the support member 300 with the above-described pressing states, and the legs 503 penetrate through the engaging holes, and the ends of the legs 503 are engaged to bottom surface.

Designated by 600 is an ink supply member, which comprises a tube 601 for receiving supply of the ink from unshown ink accommodation portion (ink container) and an ink conduction portion 602 having one end connected to a receptor opening 401 of the ink ejection portion formation member 400 and the other end connected to the tube 601. The ink supply member 600 is integrally molded together with the ink conduction portion 602 and the like from resin material or the like. A filter (not shown) is provided at an end portion of tube 601 to prevent fine foreign matter other than the ink from being supplied from the ink accommodation portion side. The ink supply member 600 is coupled with the support member 300.

The ink ejection outlets 403 of the recording head portion 700 thus constructed are formed to be inclined upwardly by an angle of θ° (opening angle) relative to axis of the liquid passage 405 as shown in FIG. 3. According to this embodiment, the directions of the ink ejection outlets 403, namely, the ejection directions are deflected for each blocks of the ink ejection outlets 403, so that the ink droplets are deposited substantially correctly on a line on a recording material.

The following is assumed. A deflection angle (digging angle) is α°. The relative speed of the recording head 700 with respect to the recording material (recording sheet) 800 is Vc. The ink is ejected through the ink ejection outlet array of a first block, and thereafter, the ink is ejected through the second block, and these are repeated sequentially.

Further, it is assumed that the gap between the recording sheet 800 and the ink ejection outlet array is S, and the flying times of the ink in the first block and second block are T1 and T2, and the flying speed is V.

$$T1=S/V\cos\theta \quad (1)$$

$$T2=S/V\cos\alpha \quad (2)$$

The condition for shooting the ink droplets on a line on the recording sheet 800 from the first block and the second block, is $$S\tan\theta-(vc-V\sin\theta)T1=S\tan\alpha-(vc-V\sin\alpha)T2-vcxTB \quad (3)$$

Where TB is a delay time between j the ink ejection of the first block and the ink ejection of the second block.

Figure 5:
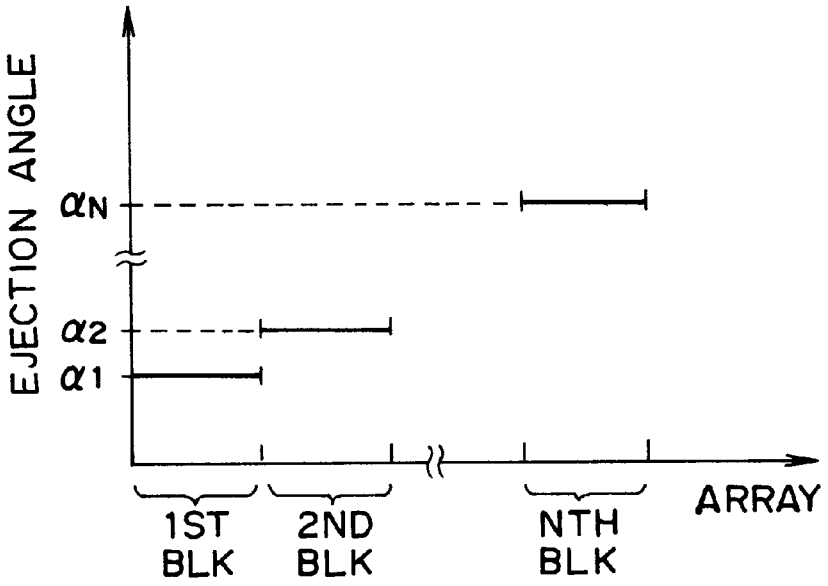
FIG. 5 illustrates a change of ejection outlet opening angle during block operation according to an embodiment of ink jet head.
Figures 6A, 6B:
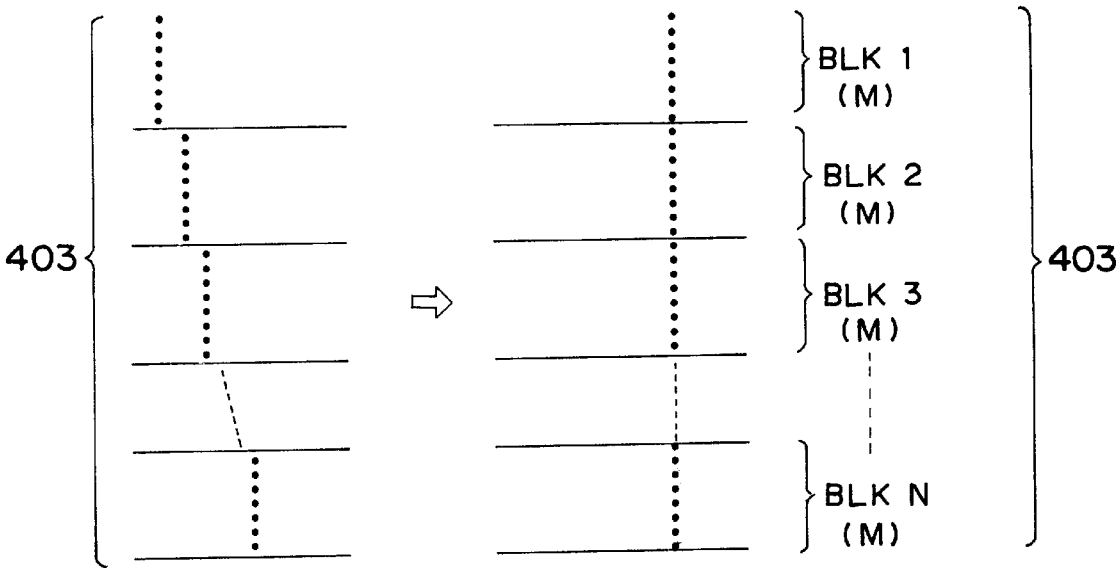
FIGS. 6A–B show a schematic comparison between recording of vertical lines by the prior art and the present invention.

Thus, the opening angle of α is determined to satisfy the equation (3). When the ink is ejected from N blocks, the digging angle of α is sequentially determined, more particularly, the θ is α1 for the first block, α2 for the second block, α3 for the third block, and αN of the Nth block. FIG. 5 shows a relation with the block boring angles when each of first—Nth blocks has M ink ejection outlets 403, and the digging angles of θ for determining the ink ejection directions are gradually increased from α1 to αN. In FIGS. 6A–B, by changing the boring directions of the ink ejection outlets 403 so as to reduce the recording position deviation, the longitudinal line can be correctly printed as a line, unlike the prior art.

When, as in this embodiment, the opening angle of the first block is approx. 90 degrees, relative to the recording material, and the opening angles of the subsequent blocks are directed to the downstream with respect to the recording direction on the recording sheet (direction 2 in opening angle), the angle increases with the increase of the block number.

When, in contrast, the last block angle is approximately a right angle, the prior blocks are inclined more with the decrease of the block number.

Figures 7A, 7B:
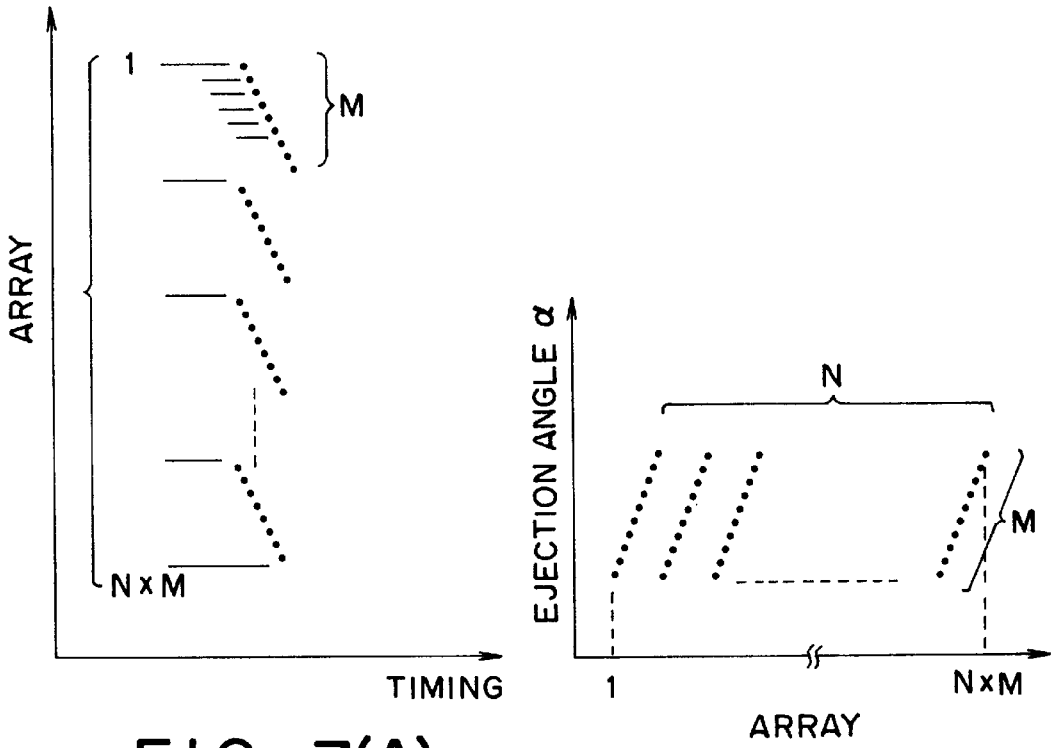
FIGS. 7A–B show the timing of ink ejection according to another embodiment of the present invention in (7A), and a relation between the ink ejection outlet arrangement order the ejection angle in (7B).

FIGS. 7A–B deal with the case in which N blocks each having M ink ejection outlets 403 are arranged in an array in a recording head portion. The same numbering ink ejection outlets in each block are simultaneously driven. FIG. 7A shows ink ejection timing. In this case, the digging angles of the ink ejection outlets are set as shown in this FIG. 7B. Thus, the ink ejection outlets simultaneously driven have the same digging angles even if they are in different blocks.

Figure 8:
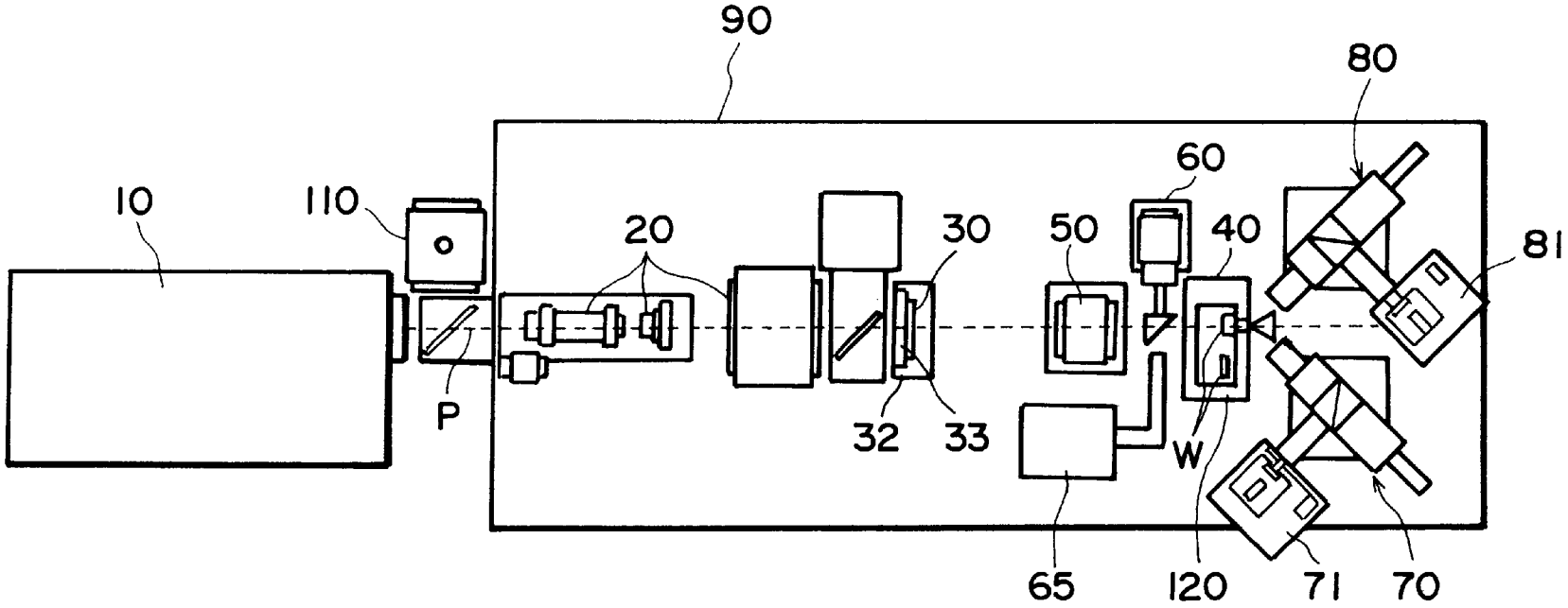
FIG. 8 is a plan view of an example of a laser boring machine.
Figure 9:
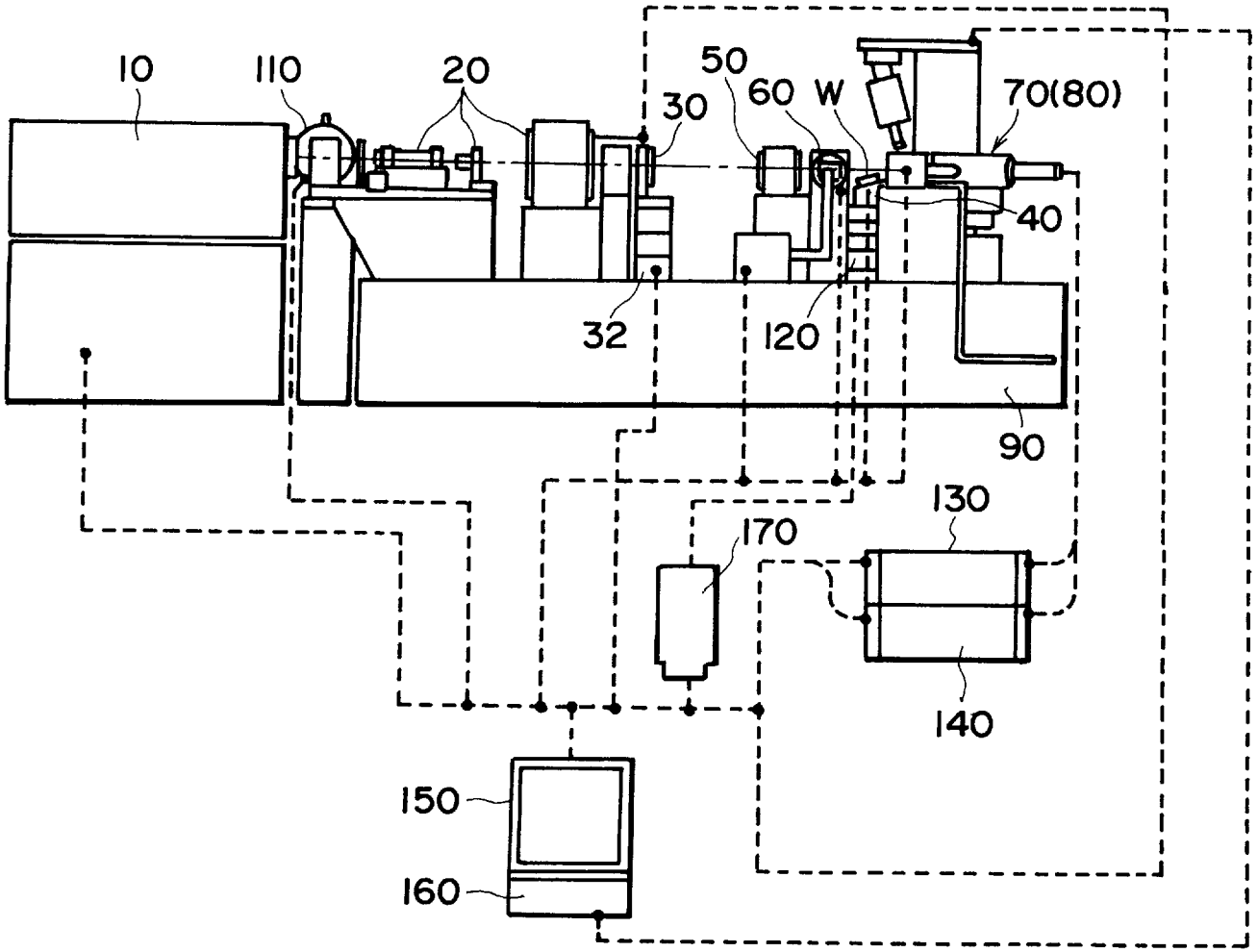
FIG. 9 is a block diagram of a control system for the laser boring machine of FIG. 8.

FIGS. 8 and 9 show an example of a laser boring machine usable for forming N×M ink ejection outlets with different boring angles. The machine has a laser light source 10 for generating a high intensity excimer laser beam. The emitted laser light P is directed to an ejection outlet side surface of an ink ejection outlet formation member 400 (workpiece) correctly positioned by a jig 40, through illumination optical system and a mask 30 having a pattern corresponding to the ink ejection outlets.

The boring machine comprises a frame 90, an illumination optical system 20 for uniformly illuminating the mask 30 with the laser light P from the laser light source 10, a position adjustment mechanism 32 for positional adjustment for the mask 30, a movement stage 120 for movably supporting the positioning jig 40 on which the is mounted, a projection optical system 50 for projecting a mask image on the workpiece W, a transmission illumination system 60 for illuminating the workpiece W with the illumination light from the laser light source 10 upon alignment operation for the workpiece W, a reflection optical system 65 for projecting the illumination light in the direction opposite from the transmission illumination system 60 (opposite from the laser source), and a measurement optical system 70, 80 for imaging the light image formed on the workpiece W by illumination of the transmission illumination system 60 and reflection optical system 65, on two industrial TVs (ITV). Also, there are provided, as shown in in FIG. 9, two image processing systems 130 and 140 for receiving the image signals of the image formed on the ITVs 71 and 81 and for effecting signal processing for the alignment, and a control system having a display device 150 for controlling actuation of the laser light source 10 and the alignment of the workpiece W.

The description will be made as to the boring operation for the ink ejection outlets 403 according to the present invention, using the boring machine as shown in FIGS. 8 and 9.

Figure 10A:
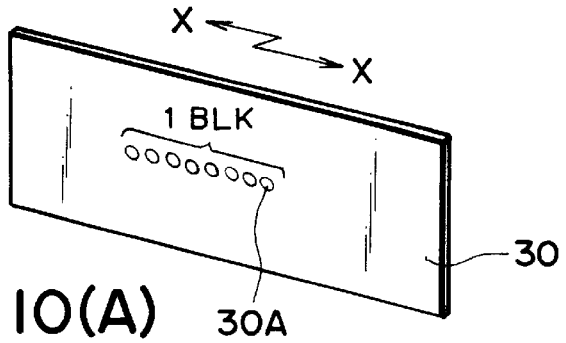
FIGS. 10A–B show two examples of a mask usable with the machine of FIGS. 8, 9.

The boring operation is carried out with a combination with a displacement operation for workpiece per se, namely, ink ejection portion formation member 400 by a combination of X direction movement and θX direction rotation of the mask 30 and movement stage 120. For the embodiment wherein the boring angles of θ of the ink ejection outlets 403 are different for the blocks, the use is made with a mask 30 having mask holes 30A formed at a predetermined ejection outlet pitch for one block, as shown in FIG. 10A. In this case, after each completion of the boring of the ink ejection outlets 403 for 1 block, the ink ejection portion formation member 400 is moved in X direction through the movement stage 120 (FIGS. 8 and 9) to the position of the next block. Additionally, to provide the angle corresponding to the boring angle for the block, the member 400 is rotated in the θX direction by the movement stage 120, and then the laser boring operation is carried out. The operations are repeated for the number of the blocks (N).

Figure 10B:
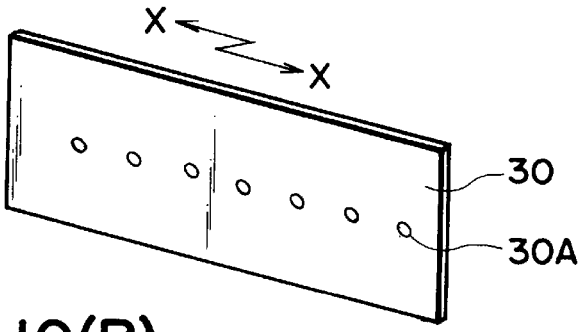

FIG. 10(B), deals with the case of the recording head for simultaneously ejecting the ink in the same direction in the respective blocks. The mask 30 has a number of mask holes 30A corresponding to the number N of the ink blocks on a line to provide the hole formation pitch for the block. Using the mask 30, the ink ejection outlets are formed in the ink ejection outlet of the ink ejection portion formation member 400 at the block formation pitch. The member 400 is moved in the X direction by the movement stage 120, and member 400 is rotated to an angle corresponding to the boring angle in the θX direction for each set of ink ejection outlets simultaneously actuated in the same direction. These operation are repeated for the ink ejection outlet number of M for the blocks.

Figure 11:
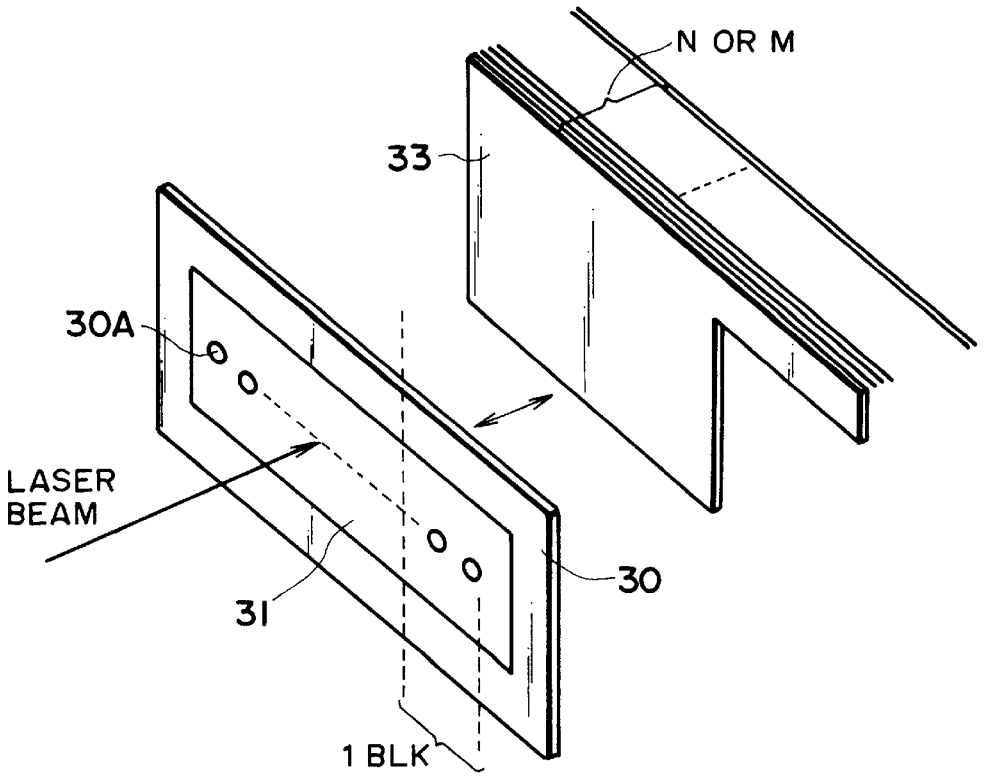
FIG. 11 is a perspective view of an example of a structure of a mask having a shutter.

FIG. 11 shows another method for the ink ejection outlet boring, according to an embodiment of the present invention using the laser boring machine as shown in FIGS. 8 and 9. In this example, mask holes 30A are formed for all of the ink ejection outlets for each blocks in the illumination region 31 of the mask 30. There is provided a shutter 33 before or after the mask. By the shutter 33, only the mask holes 30A in a certain block, for example, or only the mask holes 30Ah corresponding to the ink ejection outlets which are to eject the ink simultaneously in the same direction, are exposed. In this case, the ink ejection portion formation member 400 supported on the movement stage 120 is not required to move in the X direction for each boring step, and only the rotation in the θX direction is carried out by the movement stage 120.

In this example, the ink ejection portion formation member 400 is moved by the movement stage 120 in the X direction. In place thereof, only the θX direction rotation may be effected without movement in the X direction direction instead of moving in the X direction the mask 30 per se by the mask position adjustment mechanism 32.

Figure 12:
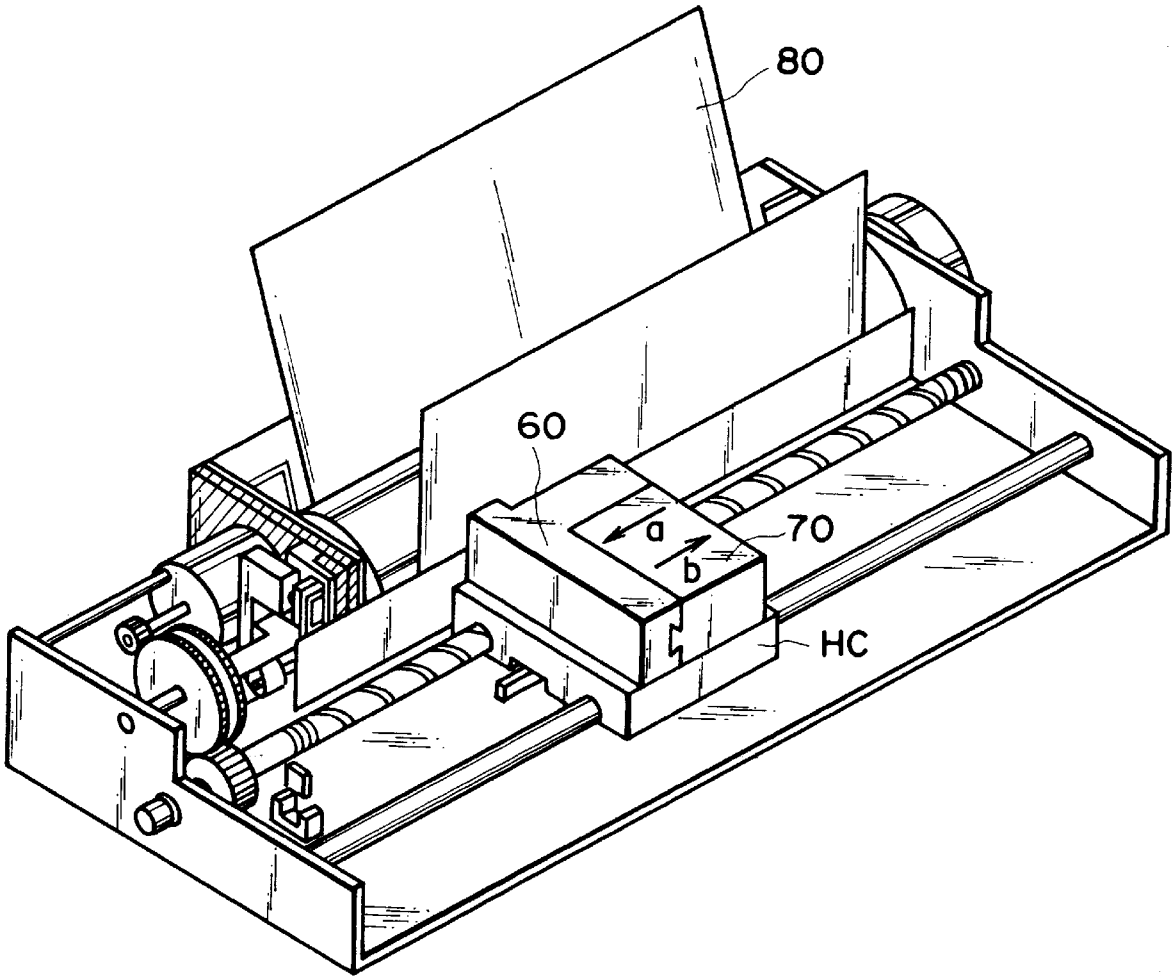
FIG. 12 is a schematic view of a recording device according to the present invention.

FIG. 12 schematically shows an outer appearance of the ink jet apparatus having an ink jet head 60 according to the present invention.

The ink jet head 60 is coupled with an ink container 70 containing the ink to be supplied to the ink jet head, and the combination is carried on the carriage HC. Although not shown, a plurality of ejection outlets of the surface 12 at the recording material 80 side of the ink jet head 60 is arranged in a line in the direction crossing with or perpendicular to the scanning direction of the carriage HC.

The recording device has driving signal supply means for supplying the driving signal for driving the ink jet head.

The signal is received by the ink jet head 60 to eject the ink to effect the recording on the recording material 80.

While the invention has been described with reference to the structures disclosed herein, it is not confined to the details set forth and this application is intended to cover such modifications or changes as may come within the purpose of the improvements or the scope of the following claims.

What is claimed is:

1. An ink jet head for effecting recording by selectively ejecting an ink onto a recording material, comprising:

a plurality of ejection outlets disposed in an array, each of said ejection outlets having an opening angle;

a plurality of ink flow paths each having an ejection energy generating element for ejecting the ink, said ink flow paths being in fluid communication with said ejection outlets;

a common liquid chamber for supplying the ink to the plurality of ink flow paths;

wherein the ejection energy generating elements are grouped into a plurality of blocks, each of said blocks comprising a predetermined number of the ejection energy generating elements, and an actuation timing for said ejection energy generating elements is deviated for each blocks;

wherein the opening angles of said ejection outlets are different for respective said blocks in a direction of reducing a deviation of recording positions between respective said blocks.

2. An ink jet head according to claim 1, wherein adjacent said ejection energy generating elements are in different blocks.

3. An ink jet head according to claim 1, wherein a part of adjacent ones of said ejection energy generating elements are in a same said block.

4. An ink jet head according to claim 1, wherein said ejection energy generation elements comprise electrical heat conversion elements.

5. An ink jet head according to claim 1, wherein said ejection energy generating elements comprise piezoelectric elements.

6. An ink jet head according to claim 1, wherein said ejection outlets are arranged in a line.

7. An ink jet head according to claim 1, wherein said opening angles of said ejection outlets are determined on a basis of a gap between the recording material and said ejection outlet, a relative speed between the recording material and the head and flying time of an ink droplet.

8. An ink jet head according to claim 1, wherein said ejection outlets are formed by a laser beam.

9. An ink jet device for effecting recording by selectively ejecting the ink onto a recording material, comprising:

an ink jet head for effecting recording by selectively ejection an ink onto the recording material, comprising:

a plurality of ejection outlets disposed in an array, each of said ejection outlets having an opening angle, a plurality of ink flow paths each having an ejection energy generating element for ejecting the ink, said ink flow paths being in fluid communication with said ejection outlets, a common liquid chamber for supplying the ink to the plurality of ink flow paths, wherein the ejection energy generating elements are grouped into a plurality of blocks, each of said blocks comprising a predetermined number of the ejection energy generating elements, and an actuation timing for said ejection energy generating elements is deviated for each blocks, and wherein the opening angles of said ejection outlets are different for respective said blocks in a direction of reducing a deviation of recording positions between respective said blocks; and driving signal supply means for driving said ejection energy generating elements of said ink jet head.

10. An ink jet head according to claim 1, wherein the provision of ejection outlets are arranged in a line extending in a direction crossing with a scanning direction of said carriage relative to the recording material, and a direction of the correction is inclined to a plane perpendicular to both of the scanning direction and the recording material.

11. An ink jet recording method, comprising the steps of:

providing a recording head including an array of ejection outlets, a plurality of ink flow paths each having an ejection energy generating element for ejecting the ink, said ink flow paths being in fluid communication with the ejection outlets, and a common liquid chamber for supplying the ink to the plurality of ink flow paths, wherein the ink is selectively ejected to effect recording on the recording material;

grouping the ejection energy generating elements into a plurality of blocks of a predetermined number of the ejection energy generating elements; and deviating for each of the blocks an actuation timing for said ejection energy generating elements;

wherein said ejection outlets have different opening angles for respective blocks in a direction of reducing a deviation of recording positions between respective said blocks.

* * * * *

UNITED STATES PATENT AND TRADEMARK OFFICE

CERTIFICATE OF CORRECTION

PATENT NO. : 5,929,879

DATED : July 27, 1999

INVENTOR(S) : SEIICHIRO KARITA ET AL.

It is certified that error appears in the above-identified patent and that said Letters Patent is hereby corrected as shown below:

ON TITLE PAGE AT [54] TITLE

"OUTLET" should read --OUTLETS--; and
"OPENINGS" should read --OPENING--.

ON TITLE PAGE AT [57] ABSTRACT

Line 7, "the a" should read --the--;
Line 11, "blocks;" should read --of the blocks;--.

COLUMN 1

Line 2, "OUTLET" should read --OUTLETS--; and
"OPENINGS" should read --OPENING--.
Line 28, "thee" should read --the--;
Line 32, "using" should read --using a--;
Line 55, "the a" should read --the--.

COLUMN 2

Line 52, "an unit" should read --a unit--.

COLUMN 3

Line 35, "each" should read --each of the--.

COLUMN 4

Line 22, "this" should be deleted.

COLUMN 5

Line 1, "0" should read --θ--;
Line 47, "direction instead" should read --instead--.

UNITED STATES PATENT AND TRADEMARK OFFICE

CERTIFICATE OF CORRECTION

PATENT NO. : 5,929,879

DATED : July 27, 1999

INVENTOR(S) : SEIICHIRO KARITA ET AL.

It is certified that error appears in the above-identified patent and that said Letters Patent is hereby corrected as shown below:

COLUMN 6

Line 17, "blocks;" should read --of said blocks;--;
Line 47, "ejection" should read --ejecting--;
Line 61, "blocks," should read --of said blocks,--.

COLUMN 7

Line 2, "provision" should read --plurality--.

Signed and Sealed this

Sixth Day of June, 2000

*Attest:*

Q. TODD DICKINSON

*Attesting Officer*

*Director of Patents and Trademarks*